US007152858B2

(12) United States Patent
Lin

(10) Patent No.: US 7,152,858 B2
(45) Date of Patent: Dec. 26, 2006

(54) GUIDING AND POSITIONING APPARATUS AND METHOD THEREOF

(75) Inventor: Tsung-Te Lin, Taipei (TW)

(73) Assignee: Benq Corporation, Taoyuan (TW)

( * ) Notice: Subject to any disclaimer, the term of this patent is extended or adjusted under 35 U.S.C. 154(b) by 145 days.

(21) Appl. No.: 10/985,583

(22) Filed: Nov. 10, 2004

(65) Prior Publication Data

US 2005/0098939 A1 May 12, 2005

(30) Foreign Application Priority Data

Nov. 11, 2003 (TW) ..... 92131505 A

(51) Int. Cl.
*B65H 3/06* (2006.01)
*B65H 1/00* (2006.01)

(52) U.S. Cl. ..... 271/117; 271/109; 271/171

(58) Field of Classification Search ..... 271/171, 271/113; 347/104; 399/393, 395; 74/25, 74/567, 568 R, 568 FS, 568 M, 568 T
See application file for complete search history.

(56) References Cited

U.S. PATENT DOCUMENTS

| | | | | | |
|---|---|---|---|---|---|
| 2,493,420 | A | * | 1/1950 | Ranney et al. | 74/57 |
| 2,604,566 | A | * | 7/1952 | Gallsen et al. | 200/61.39 |
| 3,080,765 | A | * | 3/1963 | Eisele | 74/57 |
| 3,120,761 | A | * | 2/1964 | Pravel | 74/25 |
| 4,097,042 | A | * | 6/1978 | Rozga | 271/171 |
| 4,098,501 | A | * | 7/1978 | Tani et al. | 271/117 |
| 4,351,519 | A | * | 9/1982 | Jendrick | 271/117 |
| 4,802,572 | A | * | 2/1989 | Shorey et al. | 198/791 |
| 5,106,072 | A | * | 4/1992 | Sugiura et al. | 271/117 |
| 5,116,038 | A | * | 5/1992 | Kim | 271/10.11 |
| 5,235,353 | A | * | 8/1993 | Hirano et al. | 346/145 |
| 5,294,104 | A | * | 3/1994 | Nishigaki | 271/117 |
| 5,624,109 | A | * | 4/1997 | Tanaka | 271/10.13 |
| 5,846,008 | A | * | 12/1998 | Park | 400/634 |
| 5,931,455 | A | * | 8/1999 | Okui et al. | 271/127 |
| 5,966,158 | A | * | 10/1999 | Ebata et al. | 347/104 |
| 5,975,517 | A | * | 11/1999 | Lim | 271/117 |
| 6,070,867 | A | * | 6/2000 | Tsurumi et al. | 271/114 |
| 6,315,282 | B1 | | 11/2001 | Chua et al. | |
| 2001/0002077 | A1 | * | 5/2001 | Chua et al. | 271/121 |
| 2002/0063380 | A1 | * | 5/2002 | Tamura et al. | 271/220 |

FOREIGN PATENT DOCUMENTS

JP 03-026621 * 2/1991

* cited by examiner

*Primary Examiner*—Patrick Mackey
*Assistant Examiner*—Jeremy R Severson
(74) *Attorney, Agent, or Firm*—Quintero Law Office

(57) ABSTRACT

A guiding and positioning apparatus for accurate guiding and input of a print media sheet to a business machine. The guiding and positioning apparatus includes a rotating shaft, a retaining member, a guiding member, a sliding member, a roller, a first spring, a second spring, a tray and a positioning element. The rotating shaft has a protrusion, a first end and a second end. The retaining member is fitted on the first end. The guiding member is fitted on the second end. The sliding member is fitted on the rotating shaft. The sliding member has a sliding groove and a guiding groove. The roller is fitted on the rotating shaft. The first spring is disposed between the retaining member and roller. The second spring is disposed between the roller and sliding member. The tray is disposed under the roller. The positioning element is formed on one side of the tray.

49 Claims, 7 Drawing Sheets

GUIDING AND POSITIONING APPARATUS AND METHOD THEREOF

BACKGROUND OF THE INVENTION

1. Field of the Invention

The present invention relates to a guiding and positioning apparatus, and in particular to a guiding and positioning apparatus that guides and positions a print media sheet.

2. Description of the Related Art

Print media sheets are often input to a business machine to be processed. The business machine uses an automatic or manual method to guide and position the print media sheets. The print media sheets are then accurately input to the business machine for processing.

Referring to FIG. 1, a conventional guiding and positioning device 10 is disposed on a business machine 1 and includes a roller 11 and a rotating shaft 12. The roller 11 is fitted on the rotating shaft 12. The business machine 1 includes an automatic feeding mechanism 13 and a tray 14. Two guiding elements 15 are disposed on opposite sides of the tray 14 and a paper sheet P is placed on the tray 14. As shown in FIG. 1, the paper sheet P is input to the automatic feeding mechanism 13 manually. Namely, the paper sheet P must be placed by hand between the guiding elements 15 of the tray 14, for input to the automatic feeding mechanism 13. Thus, guiding and positioning the paper sheet P is not easily controlled. In another aspect, the guiding and positioning device 10 can use stop and reverse rotation of the roller 11 to push the rear end of the paper sheet P, such that the front end thereof can be accurately guided and positioned. Nevertheless, feeding time for the paper sheet P is extended when input to the automatic feeding mechanism 13. Similarly, guiding and positioning of the paper sheet P is not easily controlled. For example, the front edge of the paper sheet P may be easily damaged.

Hence, there is a need to provide an improved guiding and positioning apparatus to uniformly input a print media sheet (paper sheet) to a business machine and to reduce printing or scanning errors resulting from skew of the print media sheet (paper sheet). The present guiding and positioning apparatus can simultaneously guide and position the print media sheet (paper sheet) when the print media sheet (paper sheet) is advancing, thereby enhancing input speed thereof.

SUMMARY OF THE INVENTION

Accordingly, an object of the invention is to provide a guiding and positioning apparatus to accurately guide and input a print media sheet to a business machine. The guiding and positioning apparatus comprises a rotating shaft, a retaining member, a guiding member, a sliding member, a roller, a first spring, a second spring, a tray and a positioning element. The rotating shaft is disposed on the business machine and has a protrusion, a first end and a second end. The retaining member is fitted on the first end. The guiding member is fitted on the second end and is fixed on the business machine. The guiding member has a guiding portion. The sliding member is slidably fitted on the rotating shaft and adjacent to the guiding member. The sliding member has a sliding groove and a guiding groove, both formed on the outer surface thereof. The sliding groove slides on the guiding portion of the guiding member and the guiding groove slides on the protrusion of the rotating shaft. The roller is slidably fitted on the rotating shaft and between the retaining member and the sliding member to guide the print media sheet into the business machine. The first spring is disposed between the retaining member and the roller. The second spring is disposed between the roller and the sliding member. The second spring, roller and first spring slide on the rotating shaft by the motion of the sliding member. The tray is disposed on the business machine and under the roller to support the print media sheet. The positioning element is formed on one side of the tray.

The guiding and positioning apparatus further comprises a frictional element disposed on the roller. The frictional element is rubber.

The guiding groove of the sliding member further comprises a linear groove and an oblique groove connected thereto and extending out of the sliding member.

The inner cross section of the roller constitutes a morphology accommodating the cross section of the rotating shaft.

The cross section of the rotating shaft and inner cross section of the roller substantially comprises an X-shape.

The first and second springs have the same elastic coefficient.

The business machine further comprises a sensor disposed on the tray to detect the print media sheet.

The business machine further comprises a cam and a gear set connected to the cam and rotating shaft. The cam pushes against the tray.

The business machine further comprises a motor connected to the gear set.

The print media sheet is a paper sheet, a transparency, negative, a photographic paper sheet, or an envelope.

Another object of the invention is to provide a guiding and input method for a business machine having the guiding and positioning apparatus. The method comprises the steps of (a) pushing the tray downward; (b) placing a print media sheet on the tray; (c) rotating the rotating shaft and roller in a first direction to position the roller in an original position; (d) lifting the tray to allow the print media sheet to contact the roller; (e) rotating the rotating shaft and roller in a second direction to slide the sliding groove of the sliding member on the guiding portion of the guiding member and move the guiding groove thereof on the protrusion of the rotating shaft, wherein the sliding member axially pushes the second spring, roller and first spring by pushing the protrusion of the rotating shaft and guiding the guiding portion of the guiding member, such that the roller simultaneously rotates and moves to push the print media sheet on the tray and the print media sheet is accurately guided and positioned by the positioning element of the tray and is input to the business machine; (f) pushing the tray downward to separate the print media sheet from the roller; and (g) rotating the rotating shaft and roller in the first direction to axially slide the roller and sliding member to the original position by means of resilience provided by the first and second springs.

In step (a), the tray is pushed downward by rotation of the cam.

In step (c), the rotating shaft and roller are rotated by transmission of the gear set and motor.

In step (d), the tray is lifted by rotation of the cam.

In step (e), the rotating shaft and roller are rotated by transmission of the gear set and motor.

In step (f), the tray is pushed downward by rotation of the cam.

In step (g), the rotating shaft and roller are rotated by transmission of the gear set and motor.

In step (g), the sliding groove of the sliding member slides on the guiding portion of the guiding member and the guiding groove of the sliding member slides on the protrusion of the rotating shaft.

The first direction is opposite to the second direction.

Yet another object of the invention is to provide a guiding and input method for a business machine having the guiding and positioning apparatus. The method comprises the steps of (a) pushing the tray downward; (b) placing a print media sheet on the tray; (c) lifting the tray to allow the print media sheet to contact the roller; and (d) rotating the rotating shaft and roller to slide the sliding groove of the sliding member on the guiding portion of the guiding member and slide the guiding groove thereof on the protrusion of the rotating shaft, wherein the sliding member axially pushes the second spring, roller and first spring by pushing the protrusion of the rotating shaft and guiding the guiding portion of the guiding member, such that the roller simultaneously rotates and moves, pushing the print media sheet on the tray and the print media sheet is accurately guided and positioned by the positioning element of the tray and is input to the business machine.

Yet another object of the invention is to provide a guiding and positioning method for a business machine having the guiding and positioning apparatus. The method comprises the steps of (a) pushing the tray downward; (b) placing a print media sheet on the tray; (c) lifting the tray to allow the print media sheet to contact the roller; and (d) rotating the rotating shaft and roller to slide the sliding groove of the sliding member on the guiding portion of the guiding member and slide the guiding groove thereof on the protrusion of the rotating shaft, wherein the sliding member axially pushes the second spring, roller and first spring by pushing the protrusion of the rotating shaft and guiding the guiding portion of the guiding member, such that the roller simultaneously rotates and moves to push the print media sheet on the tray and the print media sheet is accurately guided and positioned by the positioning element of the tray.

A detailed description is given in the following embodiments with reference to the accompanying drawings.

BRIEF DESCRIPTION OF THE DRAWINGS

The present invention can be more fully understood by reading the subsequent detailed description and examples with references made to the accompanying drawings, wherein.

DETAILED DESCRIPTION OF THE INVENTION

Figure 1:
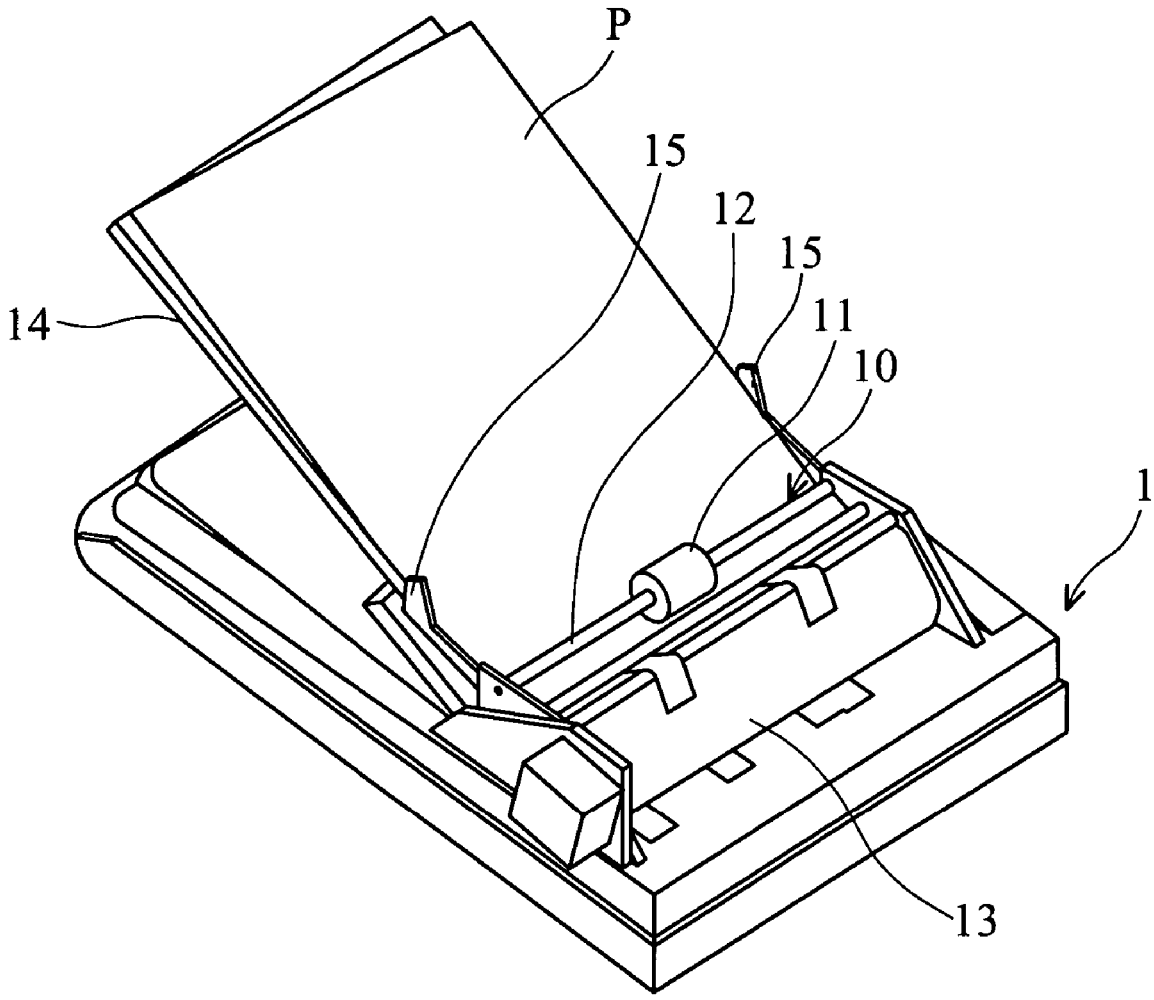
FIG. 1 (RELATED ART)
FIG. 1 is a schematic perspective view showing a conventional guiding and positioning device and a business machine.
Figure 2:
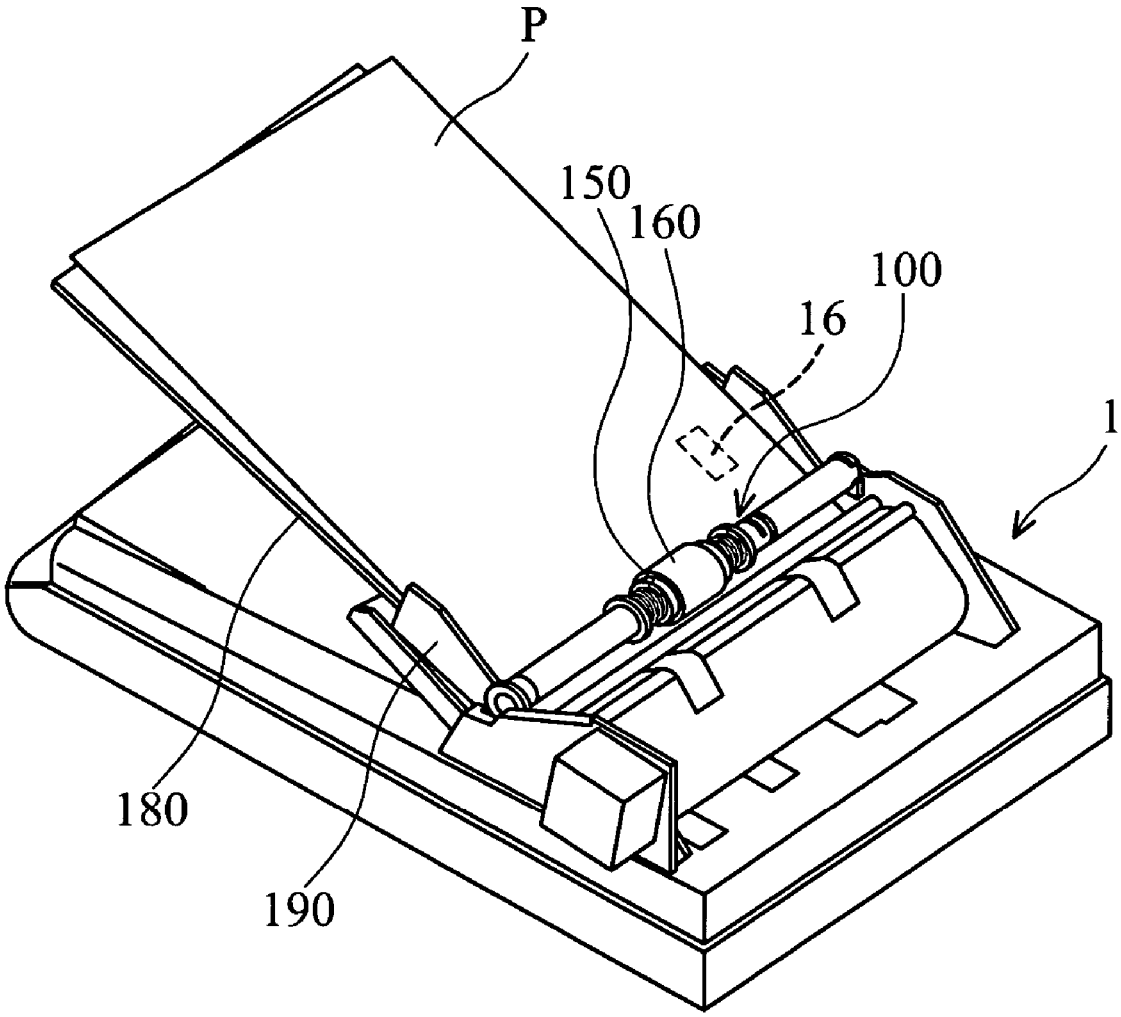
FIG. 2 is a schematic perspective view showing the guiding and positioning apparatus and business machine of the invention.

Referring to FIG. 2, the guiding and positioning apparatus 100 is disposed on a business machine 1 to guide and position a print media sheet P and input the print media sheet P thereto. The print media sheet P may be a paper sheet, a transparency, negative, a photographic paper sheet, or an envelope.

Figure 3A:
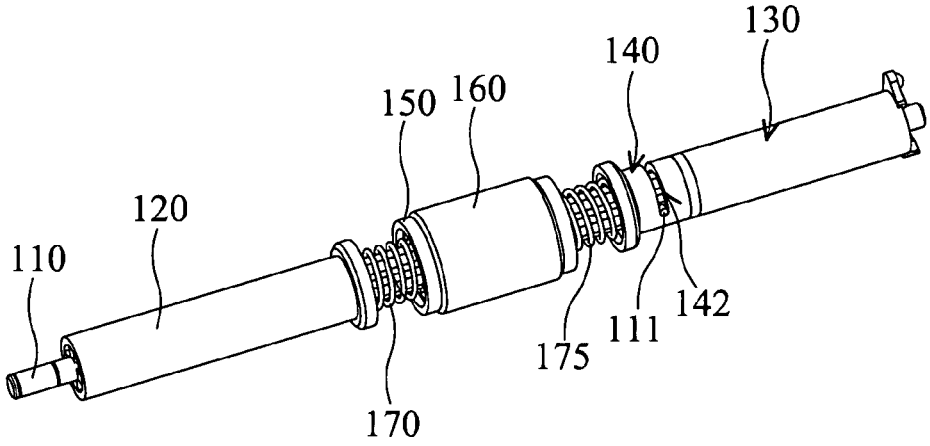
FIG. 3A is a perspective assembly view showing the partial guiding and positioning apparatus of the invention.
Figure 3B:
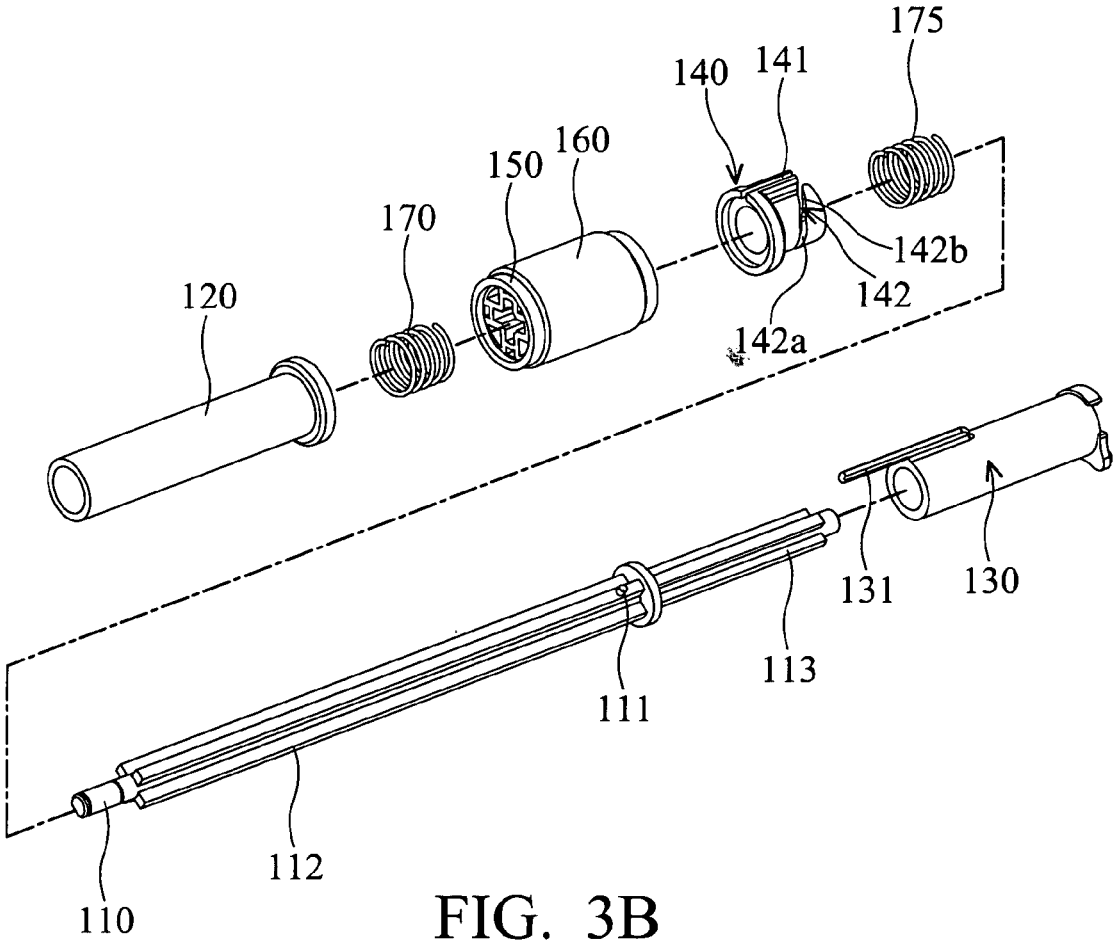
FIG. 3B is a perspective exploded view showing the partial guiding and positioning apparatus of the invention.

Referring to FIG. 3A and FIG. 3B, the guiding and positioning apparatus 100 comprises a rotating shaft 110, a retaining member 120, a guiding member 130, a sliding member 140, a roller 150, a frictional element 160, a first spring 170, a second spring 175, a tray 180 and a positioning element 190.

As shown in FIGS. 2, 3A and 3B, the rotating shaft 110 is disposed on the business machine 1 and has a protrusion 111, a first end 112 and a second end 113. Specifically, the cross section of the rotating shaft 110 substantially comprises an X-shape.

The retaining member 120 is fitted on the first end 112 of the rotating shaft 110. The guiding member 130 is fitted on the second end 113 of the rotating shaft 110 and is fixed on the business machine 1. As shown in FIG. 3B, the guiding member 130 has a guiding portion 131 extending beyond the end of the guiding member 130.

The sliding member 140 is slidably fitted on the rotating shaft 110 and adjacent to the guiding member 130. The sliding member 140 has a sliding groove 141 and a guiding groove 142, both formed on the outer surface thereof. The guiding groove 142 has a linear groove 142*a* and an oblique groove 142*b* connected thereto and extending out of the sliding member 140. Specifically, the sliding groove 141 slides on the guiding portion 131 of the guiding member 130, and the linear groove 142*a* and oblique groove 142*b* slide on the protrusion 111 of the rotating shaft 110.

The roller 150 is slidably fitted on the rotating shaft 110 and between the retaining member 120 and the sliding member 140 to guide the print media sheet P into the business machine 1. Specifically, as shown in FIG. 3B, the inner cross section of the roller 150 constitutes a morphology accommodating the cross section of the rotating shaft 110. Thus, the roller 150 can slide only on the rotating shaft 110 and cannot rotate relative thereto after being fitted thereon.

The frictional element 160 covers the outer surface of the roller 150. Specifically, the frictional element 160 is composed of a material with a high friction coefficient, such as rubber, to securely hold the print media sheet P.

The first spring 170 is disposed between the retaining member 120 and the roller 150, and the second spring 175 is disposed between the roller 150 and the sliding member 140. In this embodiment, the first spring 170 and second spring 175 have the same elastic coefficient. Specifically, when the sliding member 140 slides on the rotating shaft 110, the first spring 170 and second spring 175 can be compressed and the second spring 175, roller 150 and first spring 170 can thereby slide on the rotating shaft 110.

As shown in FIG. 2, the tray 180 is disposed on the business machine 1 and under the roller 150 (frictional element 160) to support the print media sheet P. The positioning element 190 is formed on one side of the tray 180 to serve as a guiding and positioning datum with respect to the print media sheet P.

Additionally, as shown in FIG. 2, a sensor 16 is disposed on the tray 180 to detect whether the print media sheet P is on the tray 180 or not.

Figure 4:
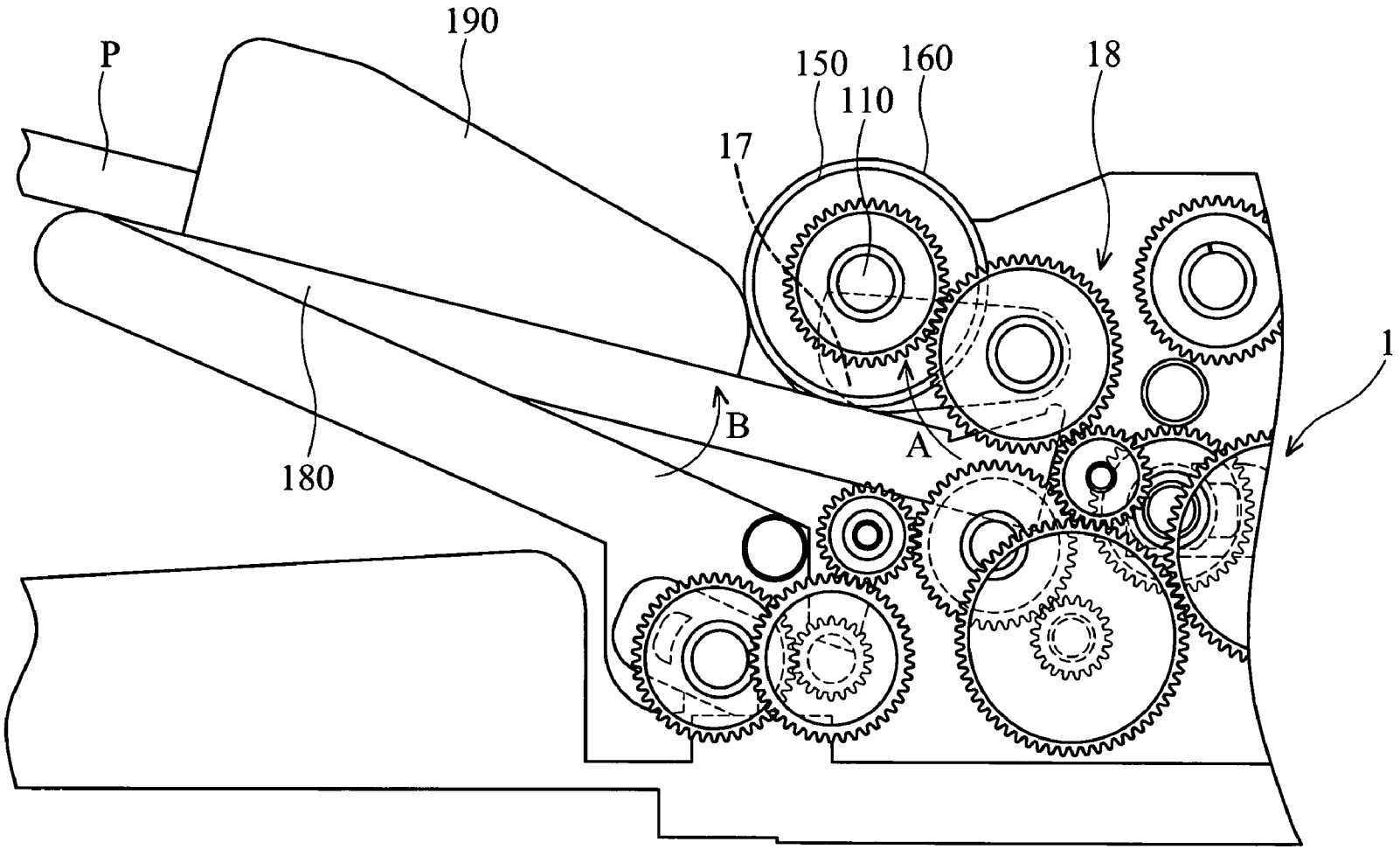
FIG. 4 is a schematic side view showing the guiding and positioning apparatus and business machine of the invention.

Additionally, as shown in FIG. 4, the business machine 1 has a cam 17, a gear set 18 and a motor (not shown). The gear set 18 is connected to the cam 17 and rotating shaft 110 of the guiding and positioning apparatus 100. The cam 17 pushes against the tray 180. The motor is connected to the gear set 18 to actuate the gear set 18, cam 17 and rotating shaft 110.

The following description is directed to the operation of the guiding and positioning apparatus 100.

Figure 5:
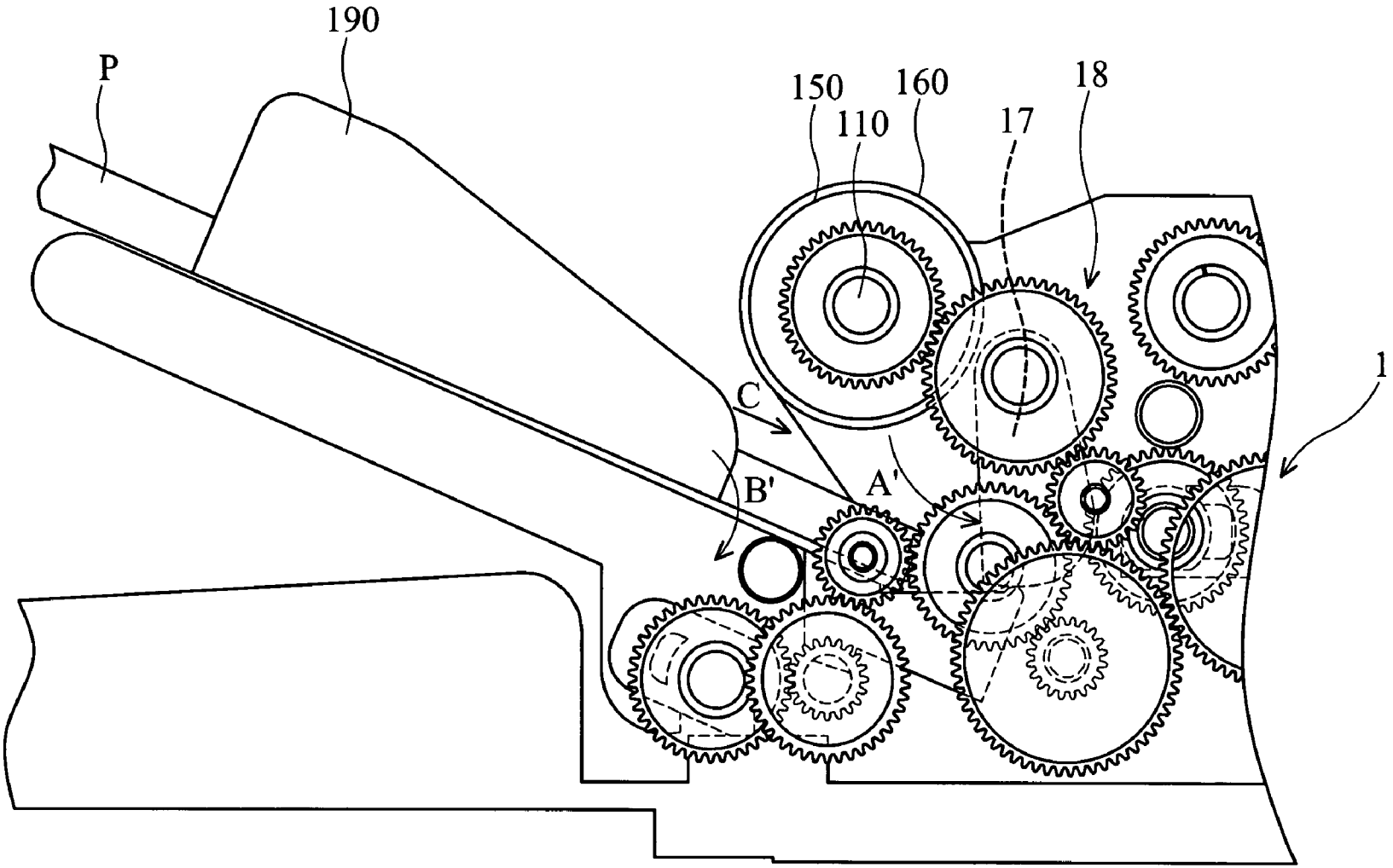
FIG. 5 is another schematic side view showing the guiding and positioning apparatus and business machine of the invention.
Figure 6:
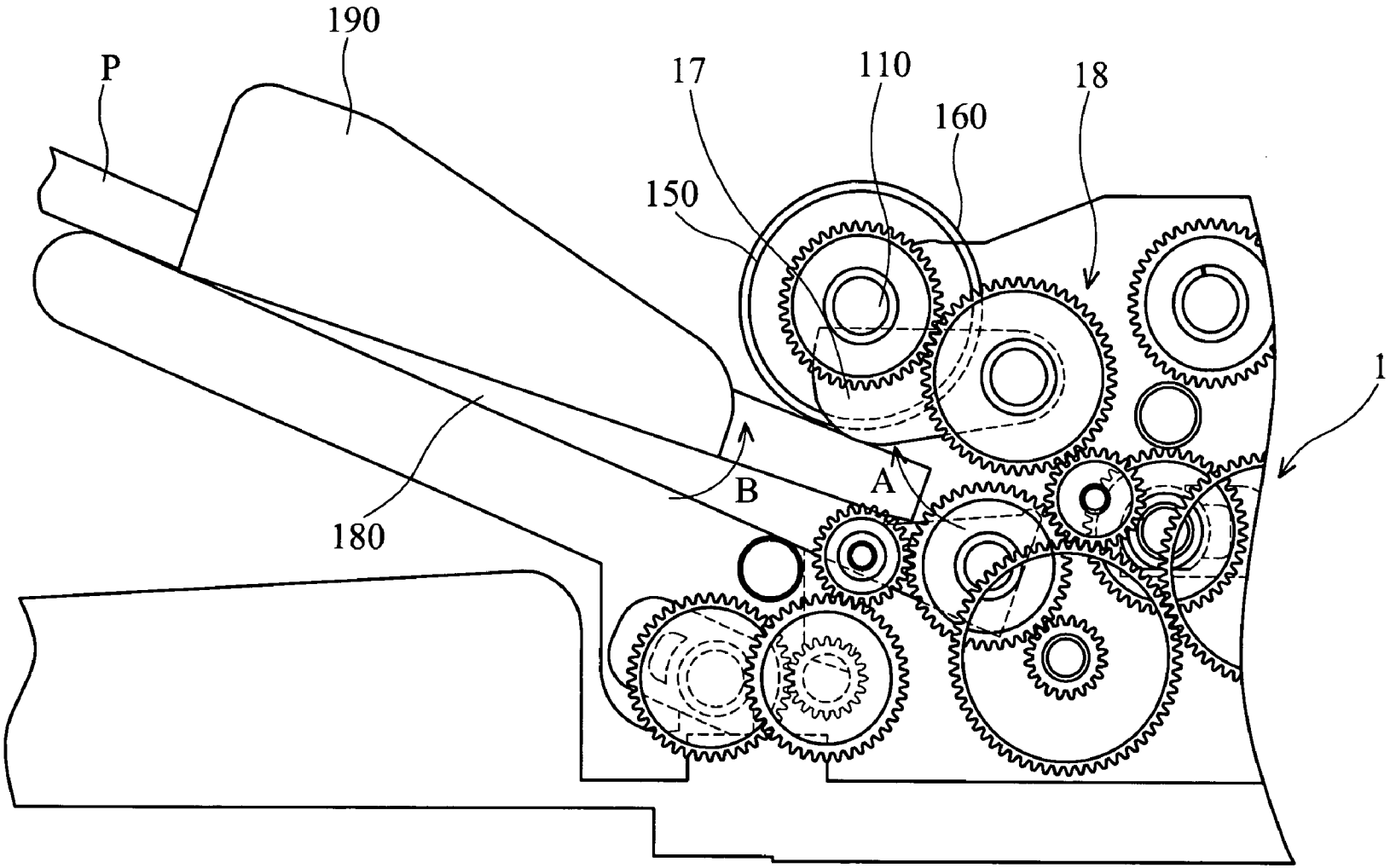
FIG. 6 is another schematic side view showing the guiding and positioning apparatus and business machine of the invention.
Figure 7A:
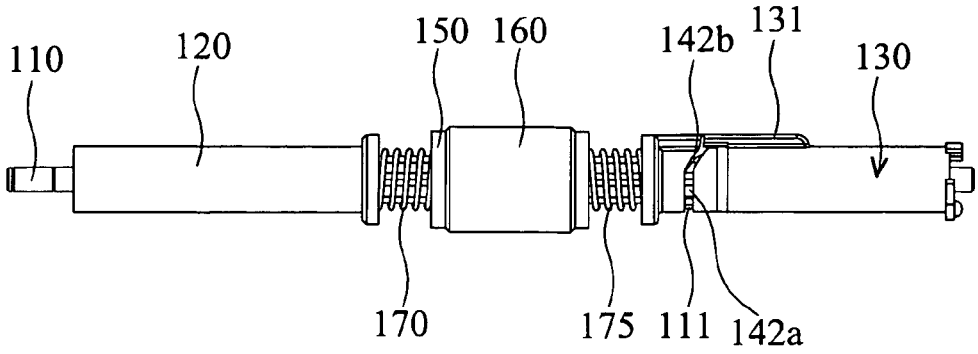
FIGS. 7A, 7B and 7C are schematic side views showing the operation of the partial guiding and positioning apparatus of the invention.
Figure 7B:
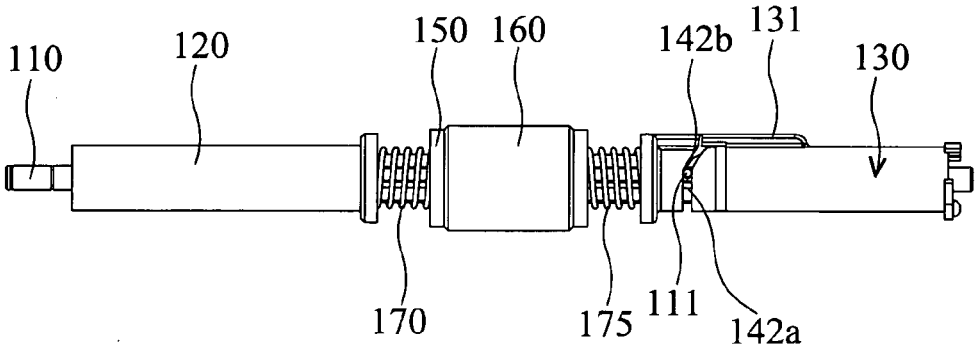
Figure 7C:
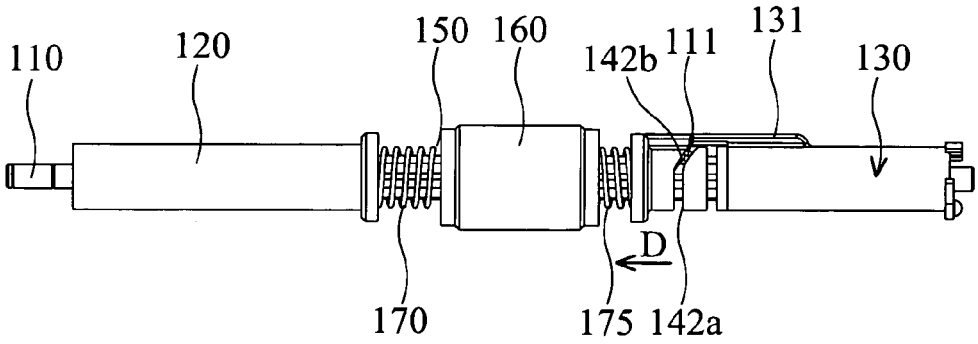

As shown in FIG. 4, the cam 17 is rotated in a direction shown by arrow A to release the tray 180 by transmission of the motor and gear set 18 before the print media sheet P is placed on the tray 180. At this point, the tray 180 is lifted in a direction shown by arrow B. The print media sheet P is then placed on the tray 180. As shown in FIG. 5, the cam 17 is rotated in a direction shown by arrow A' to push the tray 180 downward by transmission of the motor and gear set 18. At this point, the tray 180 is rotated downward in a direction shown by arrow B' and the print media sheet P slides downward to a position under the roller 150 (frictional element 160) in a direction shown by arrow C. The rotating shaft 110 and roller 150 (frictional element 160), at the same time, rotate in a first direction (clockwise) by transmission of the motor and gear set 18 to position the roller 150 at an original position. As shown in FIG. 6, the cam 17 is rotated in the direction shown by arrow A by reverse operation of the motor and transmission of the gear set 18, such that the tray 180 is lifted in the direction shown by arrow B. At this point, the print media sheet P contacts the frictional element 160 of the roller 150. The rotating shaft 110 and roller 150 (frictional element 160), at the same time, rotate in a second direction (counterclockwise) by reverse operation of the motor and transmission of the gear set 18 to hold the print media sheet P. As shown in FIG. 7A, the linear groove 142*a* of the sliding member 140 first slides on the protrusion 111 of the rotating shaft 110. At this point, the roller 150 (frictional element 160) on the rotating shaft 110 only rotates and does not slide, such that the print media sheet P can be partially guided into the business machine 1. When the rotating shaft 110 rotates from 0° to 160°, as shown in FIG. 7B, the protrusion 111 of the rotating shaft 110 enters the oblique groove 142*b* of the sliding member 140 from the linear groove 142*a* thereof. As shown in FIG. 7C, when the rotating shaft 110 rotates over 160°, the oblique groove 142*b* of the sliding member 140 slides on the protrusion 111 of the rotating shaft 110. The oblique groove 142*b* of the sliding member 140 then slides out of the protrusion 111 of the rotating shaft 110. At this point, the sliding member 140 axially pushes the second spring 175, roller 150 and first spring 170 in a direction shown by arrow D by pushing the protrusion 111 of the rotating shaft 110 and guiding the guiding portion 131 of the guiding member 130, such that the roller 150 (frictional element 160) simultaneously rotates and moves to push the print media sheet P on the tray 180. The print media sheet P is then accurately guided and positioned by the positioning element 190 on the side of the tray 180 and is successfully input to the business machine 1. Specifically, though the maximum axial displacement of the sliding member 140 is fixed, the guiding and positioning apparatus 100 can use the first spring 170 and second spring 175, with different elastic coefficient, to adjust the maximum axial displacement of the roller 150 according to actual skew level or thickness of the print media sheet P.

The cam 17 then rotates to push the tray 180 downward by transmission of the motor and gear set 18, such that the print media sheet P can be separated from the roller 150. Finally, the rotating shaft 110 and roller 150 (frictional element 160) are again rotated in the first direction (clockwise) by transmission of the motor and gear set 18, such that the roller 150 and sliding member 140 axially slide to the original position by resilience provided by the first spring 170 and second spring 175. Specifically, the protrusion 111 of the rotating shaft 110 enters the oblique groove 142*b* and linear groove 142*a* of the sliding member 140 in sequence.

Additionally, when the sensor 16 on the tray 180 again detects the print media sheet P, the guiding and positioning apparatus 100 repeats the aforementioned steps to guide and input the print media sheet P into the business machine 1.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A guiding and positioning apparatus for accurately guiding and inputting a print media sheet to a business machine, comprising:

a rotating shaft disposed on the business machine, with a protrusion, a first end and a second end;

a retaining member fitted on the first end;

a guiding member fitted on the second end and fixed on the business machine, with a guiding portion;

a sliding member slidably fitted on the rotating shaft and adjacent to the guiding member, wherein the sliding member has a sliding groove and a guiding groove, both formed on the outer surface thereof, the sliding groove sliding on the guiding portion of the guiding member, and the guiding groove sliding on the protrusion of the rotating shaft;

a roller slidably fitted on the rotating shaft and between the retaining member and the sliding member to guide the print media sheet into the business machine;

a first spring disposed between the retaining member and the roller;

a second spring disposed between the roller and the sliding member, wherein the second spring, roller and first spring slide on the rotating shaft by movement of the sliding member;

a tray disposed on the business machine and under the roller to support the print media sheet; and a positioning element formed on one side of the tray.

2. The guiding and positioning apparatus as claimed in claim 1, further comprising a frictional element disposed on the roller.

3. The guiding and positioning apparatus as claimed in claim 2, wherein the frictional element is rubber.

4. The guiding and positioning apparatus as claimed in claim 1, wherein the guiding groove of the sliding member further comprises a linear groove and an oblique groove connected thereto and extending out of the sliding member.

5. The guiding and positioning apparatus as claimed in claim 1, wherein the inner cross section of the roller constitutes a morphology accommodating the cross section of the rotating shaft.

6. The guiding and positioning apparatus as claimed in claim 5, wherein the cross section of the rotating shaft and inner cross section of the roller substantially comprise an X-shape.

7. The guiding and positioning apparatus as claimed in claim 1, wherein the first and second springs have the same elastic coefficient.

8. The guiding and positioning apparatus as claimed in claim 1, wherein the business machine further comprises a sensor disposed on the tray for detecting the print media sheet.

9. The guiding and positioning apparatus as claimed in claim 1, wherein the business machine further comprises a cam and a gear set connected to the cam and rotating shaft, and the cam pushes against the tray.

10. The guiding and positioning apparatus as claimed in claim 9, wherein the business machine further comprises a motor connected to the gear set.

11. The guiding and positioning apparatus as claimed in claim 1, wherein the print media sheet is a paper sheet, a transparency, negative, a photographic paper sheet, or an envelope.

12. A guiding and input method for a business machine having a guiding and positioning apparatus comprising a rotating shaft, a retaining member, a guiding member, a sliding member, a roller, a first spring, a second spring, a tray and a positioning element, the rotating shaft disposed on the business machine and having a protrusion, a first end and a second end, the retaining member fitted on the first end, the guiding member fitted on the second end and fixed on the business machine, the guiding member having a guiding portion, the sliding member slidably fitted on the rotating shaft and adjacent to the guiding member, the sliding member having a sliding groove and a guiding groove, both formed on the outer surface thereof, the roller slidably fitted on the rotating shaft and between the retaining member and the sliding member, the first spring disposed between the retaining member and the roller, the second spring disposed between the roller and the sliding member, the tray disposed on the business machine and under the roller, the positioning element formed on one side of the tray, the method comprising the steps of:

(a) pushing the tray downward;

(b) placing a print media sheet on the tray;

(c) rotating the rotating shaft and roller in a first direction to position the roller in an original position;

(d) lifting the tray to allow the print media sheet to contact the roller;

(e) rotating the rotating shaft and roller in a second direction to slide the sliding groove of the sliding member on the guiding portion of the guiding member and slide the guiding groove thereof on the protrusion of the rotating shaft, wherein the sliding member axially pushes the second spring, roller and first spring by pushing the protrusion of the rotating shaft and guiding the guiding portion of the guiding member, such that the roller simultaneously rotates and moves to push the print media sheet on the tray and the print media sheet is accurately guided and positioned by the positioning element of the tray and is input to the business machine;

(f) pushing the tray downward to separate the print media sheet from the roller; and (g) rotating the rotating shaft and roller in the first direction to axially slide the roller and sliding member to the original position by resilience provided by the first and second springs.

13. The guiding and input method as claimed in claim 12, wherein the business machine further comprises a motor, a gear set and a cam, the motor connected to the gear set, the gear set connected to the cam and rotating shaft, and the cam pushing against the tray.

14. The guiding and input method as claimed in claim 13, wherein, in the step (a), the tray is pushed downward by rotation of the cam.

15. The guiding and input method as claimed in claim 13, wherein, in the step (c), the rotating shaft and roller are rotated by transmission of the gear set and motor.

16. The guiding and input method as claimed in claim 13, wherein, in the step (d), the tray is lifted by rotation of the cam.

17. The guiding and input method as claimed in claim 13, wherein, in the step (e), the rotating shaft and roller are rotated by transmission of the gear set and motor.

18. The guiding and input method as claimed in claim 13, wherein, in the step (f), the tray is pushed downward by rotation of the cam.

19. The guiding and input method as claimed in claim 13, wherein, in the step (g), the rotating shaft and roller are rotated by transmission of the gear set and motor.

20. The guiding and input method as claimed in claim 12, wherein, in the step (e), the guiding groove of the sliding member comprises a linear groove and an oblique groove connected thereto and extending out of the sliding member.

21. The guiding and input method as claimed in claim 12, wherein, in the step (g), the sliding groove of the sliding member slides on the guiding portion of the guiding member and the guiding groove of the sliding member slides on the protrusion of the rotating shaft.

22. The guiding and input method as claimed in claim 12, wherein the guiding and positioning apparatus further comprises a frictional element disposed on the roller.

23. The guiding and input method as claimed in claim 22, wherein the frictional element is rubber.

24. The guiding and input method as claimed in claim 12, wherein the first direction is opposite to the second direction.

25. The guiding and input method as claimed in claim 12, wherein the print media sheet is a paper sheet, a transparency, negative, a photographic paper sheet, or an envelope.

26. A guiding and input method for a business machine having a guiding and positioning apparatus having a rotating shaft, a retaining member, a guiding member, a sliding member, a roller, a first spring, a second spring, a tray and a positioning element, the method comprising the steps of:

(a) pushing the tray downward;

(b) placing a print media sheet on the tray;

(c) lifting the tray to allow the print media sheet to contact the roller; and (d) rotating the rotating shaft and roller to slide the sliding groove of the sliding member on the guiding portion of the guiding member and slide the guiding groove thereof on the protrusion of the rotating shaft, wherein the sliding member axially pushes the second spring, roller and first spring by pushing the protrusion of the rotating shaft and guiding the guiding portion of the guiding member, such that the roller simultaneously rotates and moves to push the print media sheet on the tray and the print media sheet is accurately guided and positioned by the positioning element of the tray and is input to the business machine.

27. The guiding and input method as claimed in claim 26, further comprising the steps of:

(e) pushing the tray downward to separate the print media sheet from the roller; and (f) reversing rotation of the rotating shaft and roller to axially slide the roller and sliding member to an original position by resilience provided by the first and second springs.

28. The guiding and input method as claimed in claim 27, wherein the rotating shaft is disposed on the business machine and has a protrusion, a first end and a second end, the retaining member is fitted on the first end, the guiding member is fitted on the second end and is fixed on the business machine, the guiding member has a guiding portion, the sliding member is slidably fitted on the rotating shaft and adjacent to the guiding member, the sliding member has a sliding groove and a guiding groove, both formed on the outer surface thereof, the roller is slidably fitted on the rotating shaft and between the retaining member and the sliding member, the first spring is disposed between the retaining member and the roller, the second spring is disposed between the roller and the sliding member, the tray is disposed on the business machine and under the roller, and the positioning element is formed on one side of the tray.

29. The guiding and input method as claimed in claim 28, wherein the business machine further comprises a motor, a gear set and a cam, the motor connected to the gear set, the gear set connected to the cam and rotating shaft, and the cam pushing against the tray.

30. The guiding and input method as claimed in claim 29, wherein, in the step (a), the tray is pushed downward by rotation of the cam.

31. The guiding and input method as claimed in claim 29, wherein, in the step (c), the tray is lifted by rotation of the cam.

32. The guiding and input method as claimed in claim 29, wherein, in the step (d), the rotating shaft and roller are rotated by transmission of the gear set and motor.

33. The guiding and input method as claimed in claim 29, wherein, in the step (e), the tray is pushed downward by rotation of the cam.

34. The guiding and input method as claimed in claim 29, wherein, in the step (f), rotation of the rotating shaft and roller is reversed by transmission of the gear set and motor.

35. The guiding and input method as claimed in claim 28, wherein, in the step (d), the guiding groove of the sliding member comprises a linear groove and an oblique groove connected thereto and extending out of the sliding member.

36. The guiding and input method as claimed in claim 28, wherein, in the step (f), the sliding groove of the sliding member slides on the guiding portion of the guiding member and the guiding groove of the sliding member slides on the protrusion of the rotating shaft.

37. The guiding and input method as claimed in claim 28, wherein the guiding and positioning apparatus further comprises a frictional element disposed on the roller.

38. The guiding and input method as claimed in claim 37, wherein the frictional element is rubber.

39. The guiding and input method as claimed in claim 26, wherein the print media sheet is a paper sheet, a transparency, negative, a photographic paper sheet, or an envelope.

40. A guiding and positioning method for a business machine having a guiding and positioning apparatus having a rotating shaft, a retaining member, a guiding member, a sliding member, a roller, a first spring, a second spring, a tray and a positioning element, the method comprising the steps of:

(a) pushing the tray downward;

(b) placing a print media sheet on the tray;

(c) lifting the tray to allow the print media sheet to contact the roller; and (d) rotating the rotating shaft and roller to move the sliding groove of the sliding member on the guiding portion of the guiding member and slide the guiding groove thereof on the protrusion of the rotating shaft, wherein the sliding member axially pushes the second spring, roller and first spring by pushing the protrusion of the rotating shaft and guiding the guiding portion of the guiding member, such that the roller simultaneously rotates and moves to push the print media sheet on the tray and the print media sheet is accurately guided and positioned by the positioning element of the tray.

41. The guiding and positioning method as claimed in claim 40, wherein the rotating shaft is disposed on the business machine and has a protrusion, a first end and a second end, the retaining member is fitted on the first end, the guiding member is fitted on the second end and is fixed on the business machine, the guiding member has a guiding portion, the sliding member is slidably fitted on the rotating shaft and adjacent to the guiding member, the sliding member has a sliding groove and a guiding groove, both formed on the outer surface thereof, the roller is slidably fitted on the rotating shaft and between the retaining member and the sliding member, the first spring is disposed between the retaining member and the roller, the second spring is disposed between the roller and the sliding member, the tray is disposed on the business machine and under the roller, and the positioning element is formed on one side of the tray.

42. The guiding and positioning method as claimed in claim 41, wherein the business machine further comprises a motor, a gear set and a cam, the motor connected to the gear set, the gear set connected to the cam and rotating shaft, and the cam pushing against the tray.

43. The guiding and positioning method as claimed in claim 42, wherein, in the step (a), the tray is pushed downward by rotation of the cam.

44. The guiding and positioning method as claimed in claim 42, wherein, in the step (c), the tray is lifted by rotation of the cam.

45. The guiding and positioning method as claimed in claim 42, wherein, in the step (d), the rotating shaft and roller are rotated by transmission of the gear set and motor.

46. The guiding and positioning method as claimed in claim 41, wherein, in the step (d), the guiding groove of the sliding member comprises a linear groove and an oblique groove connected thereto and extending out of the sliding member.

47. The guiding and positioning method as claimed in claim 41, wherein the guiding and positioning apparatus further comprises a frictional element disposed on the roller.

48. The guiding and positioning method as claimed in claim 47, wherein the frictional element is rubber.

49. The guiding and positioning method as claimed in claim 40, wherein the print media sheet is a paper sheet, a transparency, negative, a photographic paper sheet, or an envelope.

* * * * *